US012589849B2

(12) United States Patent
Verfaillie et al.

(10) Patent No.: US 12,589,849 B2
(45) Date of Patent: Mar. 31, 2026

(54) TETHERED-WING TRACTION SYSTEM AND METHOD FOR MOVING CARRIAGES

(71) Applicant: AIRSEAS, Nantes (FR)

(72) Inventors: Swann Verfaillie, Toulouse (FR); Nicolas Fantin, Launaguet (FR); Stephane Jan, Montgiscard (FR)

(73) Assignee: KAWASAKI KISEN KAISHA LTD, Tokyo (JP)

( * ) Notice: Subject to any disclaimer, the term of this patent is extended or adjusted under 35 U.S.C. 154(b) by 317 days.

(21) Appl. No.: 18/549,910

(22) PCT Filed: Mar. 16, 2022

(86) PCT No.: PCT/EP2022/056811
§ 371 (c)(1),
(2) Date: Sep. 9, 2023

(87) PCT Pub. No.: WO2022/194927
PCT Pub. Date: Sep. 22, 2022

(65) Prior Publication Data

US 2024/0149997 A1 May 9, 2024

(30) Foreign Application Priority Data

Mar. 19, 2021 (FR) ..... 2102791

(51) Int. Cl.
*B63H 9/072* (2020.01)

(52) U.S. Cl.
CPC ..... *B63H 9/072* (2020.02)

(58) Field of Classification Search
CPC ..... B63B 2035/009
See application file for complete search history.

(56) References Cited

U.S. PATENT DOCUMENTS

| | | | | |
|---|---|---|---|---|
| 7,287,481 | B1 * | 10/2007 | Wrage | B63B 15/0083 114/102.29 |
| 2004/0099196 | A1 * | 5/2004 | Grenier | B63H 9/069 114/102.16 |
| 2007/0157868 | A1 * | 7/2007 | Wrage | B63H 9/071 114/365 |
| 2011/0041747 | A1 * | 2/2011 | Reusch | B63H 9/069 114/39.29 |
| 2021/0253210 | A1 * | 8/2021 | Arrouy | B63H 9/072 |

FOREIGN PATENT DOCUMENTS

| | | |
|---|---|---|
| DE | 202016006694 | 12/2016 |
| FR | 3082184 | 12/2019 |

* cited by examiner

*Primary Examiner* — Evan P Dzierzynski
(74) *Attorney, Agent, or Firm* — Defillo & Associates, Inc; Evelyn A. Defillo

(57) ABSTRACT

Tethered-wing traction system including: a traction wing (5), a base platform (3), a mooring mast (4), a plurality of folding lines (10A,10B,10C), a furling line (13), a mooring carriage (12B), a folding carriage (12C, 12D, 12E), a furling carriage (12A), and a control module (64) having at least the following two operating modes: a folding mode in which the mooring carriage (12B) and the folding carriage (12C, 12D, 12E) are spaced apart from each other; and a furling mode in which the furling carriage (12A) and the mooring carriage (12B) are spaced apart from each other.

19 Claims, 10 Drawing Sheets

Fig. 4
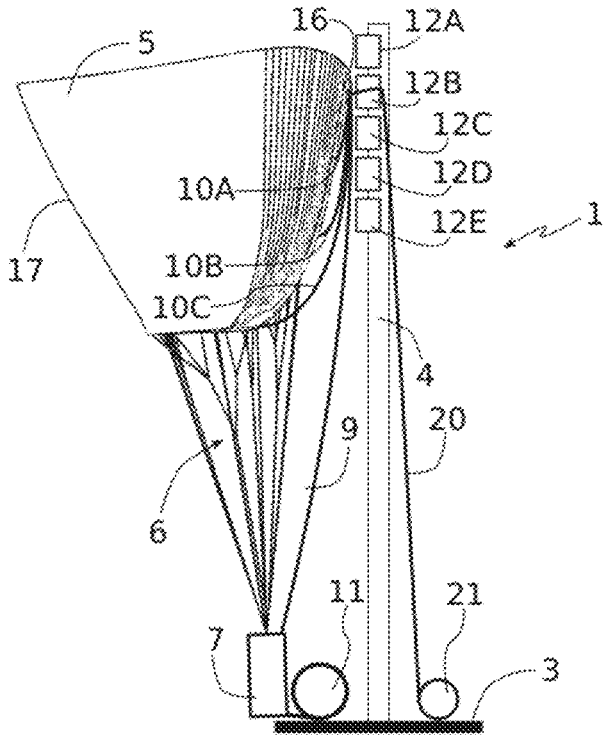
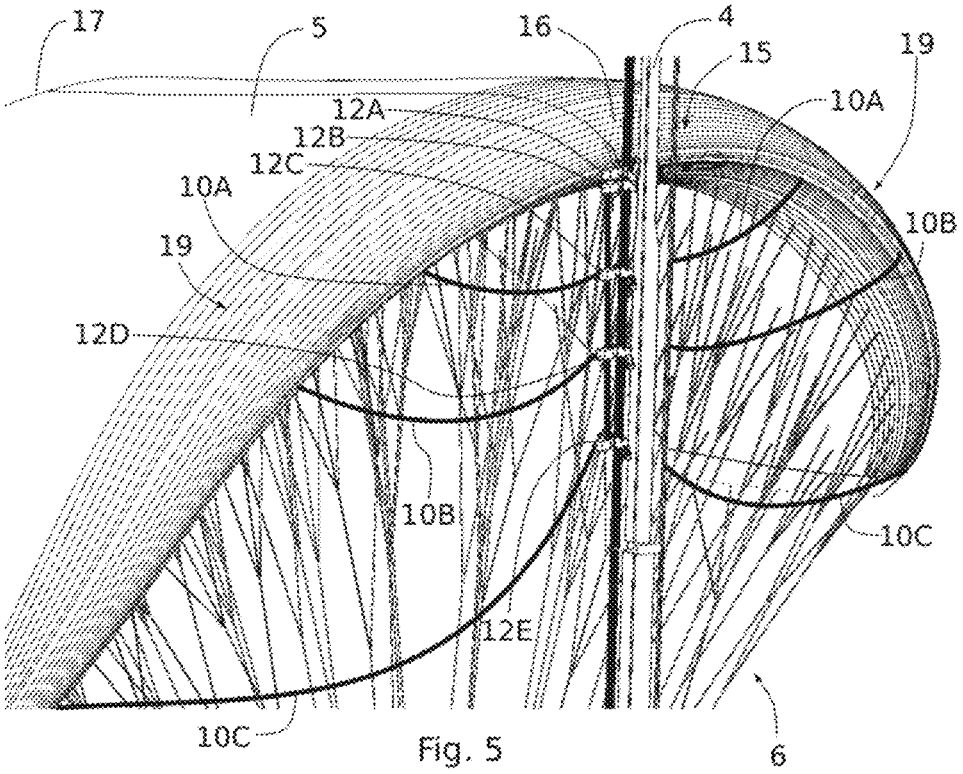
Fig. 5

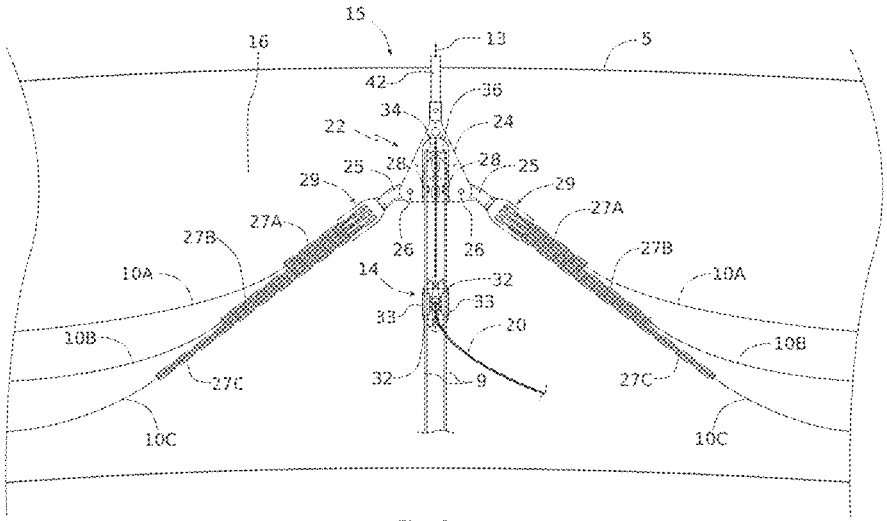
Fig. 8
Fig. 9
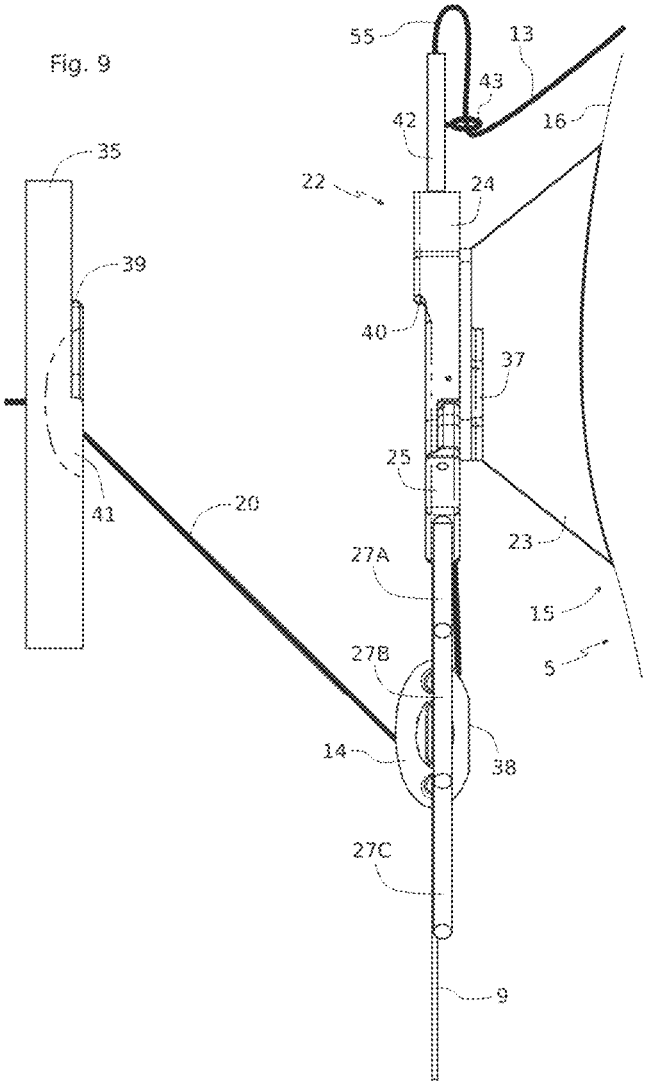

TETHERED-WING TRACTION SYSTEM AND METHOD FOR MOVING CARRIAGES

CROSS REFERENCE TO RELATED APPLICATION

This application is a national stage entry of PCT/EP2022/056811 filed Mar. 16, 2022, under the International Convention and claiming priority over French Patent Application No. FR2102791 filed Mar. 19, 2021.

TECHNICAL FIELD

The invention relates to the field of tethered-wing traction systems which are designed to deploy and fold a traction wing in relation to a base platform, this traction wing being designed to generate a traction force under the effect of the wind.

Such traction systems make it possible to deploy a flying traction wing used for the propulsion of a vehicle, notably a ship (as main propulsion or by way of support), for the generation of electricity, or for any application benefiting from such a traction force.

PRIOR ART

The French patent application FR3082184 describes a tethered-wing traction system and a process for deploying and folding the traction wing. The traction wing has folding lines fixed to its leading edge and the system has means for pulling on at least three folding lines in order to bring the leading edge against the mast at least at two different heights along this mast.

This traction system benefits from a more efficient and more reliable deployment and folding process.

SUMMARY OF THE INVENTION

An aim of the invention is to improve the tethered-wing traction systems of the prior art and the associated deployment and folding processes.

To that end, the invention concerns a tethered-wing traction system having:

- a traction wing designed to generate a traction force under the effect of the wind, this traction wing having a leading edge and a trailing edge;
- a base platform to which the traction wing is connected via a traction line, the traction wing being designed to be deployed and folded in relation to this base platform;
- a mooring mast for the traction wing, disposed on the base platform;
- multiple folding lines each having an end fixed to the leading edge of the traction wing, the ends being spaced apart from one another along this leading edge;
- a furling line connected to the trailing edge of the traction wing.

This tethered-wing traction system also has:

- a mooring carriage designed to slide along the mooring mast and controlled by a slide actuator, this mooring carriage having an engagement interface designed to keep the leading edge of the traction wing moored;
- a folding carriage designed to slide along the mooring mast and controlled by a slide actuator, this folding carriage having capturing means designed to capture at least one folding line;

- a furling carriage designed to slide along the mooring mast and controlled by a slide actuator, this furling carriage having capturing means designed to capture the furling line;
- a control module for controlling said slide actuators, this control module having at least the following two modes of operation: a folding mode in which the mooring carriage and the folding carriage are moved away from one another; a furling mode in which the furling carriage and the mooring carriage are moved away from one another.

According to another object, the invention concerns a process for folding the traction wing of a traction system as described above, this process having the following steps:

- mooring the leading edge of the traction wing to the mooring carriage;
- capturing at least one folding line by way of the folding carriage;
- sliding the folding carriage downward while the mooring carriage remains fixed in place on the mooring mast;
- capturing the furling line by way of the furling carriage;
- sliding the mooring carriage downward while the furling carriage remains fixed in place on the mooring mast.

According to another object, the invention concerns a process for deploying the traction wing of a traction system as described above, this process having the following steps:

- sliding the mooring carriage upward while the furling carriage is kept fixed in place on the mooring mast;
- sliding the folding carriage upward while the mooring carriage is kept fixed in place on the mooring mast.

Throughout the text, the terms "one" or "a" in the formulations "one/a carriage" and "one/a line" are to be understood as meaning "at least one".

In this instance, the engagement interface is designed to keep the leading edge of the traction wing moored, whether directly, or indirectly via a part.

Both for folding and for deployment of the traction wing, such a tethered-wing traction system, and the associated processes, utilize operations of folding/unfolding and furling/unfurling the traction wing that are controlled solely by the translation kinematics of the mooring, folding and furling carriages.

No complex device is necessary for these advanced folding/unfolding and furling/unfurling functions, by contrast to the prior art which generally provides winches, winders, return pulleys etc. for these same functions. These functions are therefore entirely automated without additional elements apart from the slide actuators and the control module.

Furthermore, the translation kinematics of the carriages may also be utilized for the storage/release of the traction wing before or after it is folded and furled.

The operations of folding, furling and possibly storing the traction wing are thus interlinked by the set of carriages. These functions are performed with little movable equipment (few lines, few transmissions, and few movable elements). These functions are still very complex to implement, notably in order to wind lines neatly and repeatably, especially when the tension is not perfectly managed. Frequent use is made of complex line guiding devices, tensioners etc.

These operations are, however, accelerated in relation to the prior art by virtue of the interlinking of the functions. Notably, if the wind speed rapidly increases, the folding of the traction wing is rapid and fluid, and the traction wing is rapidly put in a situation (folded and furled) in which it is sheltered from the wind.

The tethered-wing traction system according to the invention may have the following additional features, on their own or in combination:

- in the folding mode, the mooring carriage is kept fixed in place on the mooring mast and the folding carriage slides downward;
- in the furling mode, the furling carriage is kept fixed in place on the mooring mast and the mooring carriage slides downward;
- in the furling mode, the furling carriage slides upward, and the mooring carriage is kept fixed in place on the mooring mast;
- in the furling mode, the folding carriage also slides downward, the spacing between the mooring carriage and the folding carriage being kept constant;
- the control module also has the following mode of operation: an unfurling mode in which the furling carriage and the mooring carriage are moved close to one another;
- in the unfurling mode, the furling carriage is kept fixed in place on the mooring mast and the mooring carriage slides upward;
- the control module also has the following mode of operation: an unfolding mode in which the mooring carriage and the folding carriage are moved close to one another;
- in the unfolding mode, the mooring carriage is kept fixed in place on the mooring mast and the folding carriage slides upward;
- the control module also has the following mode of operation: a storage mode in which the spacing between the furling carriage and the mooring carriage is kept constant, while the mooring carriage and the folding carriage are moved close to one another;
- In the storage mode, the furling carriage and the mooring carriage slide downward while keeping their mutual spacing constant, and the folding carriage slides downward at a slower speed than the sliding speed of the mooring carriage;
- in the storage mode, the folding carriage is kept fixed in place;
- the control module also has the following mode of operation: a release mode in which the spacing between the furling carriage and the mooring carriage is kept constant, while the mooring carriage and the folding carriage are moved away from one another;
- in the release mode, the furling carriage and the mooring carriage slide upward while keeping their mutual spacing constant, and the folding carriage slides upward at a slower speed than the sliding speed of the mooring carriage;
- the system has a line capturing device which is connected to the leading edge of the traction wing and is designed to be coupled to the engagement interface of the mooring carriage, the furling carriage being designed to capture the furling line in the line capturing device, and the folding carriage being designed to capture at least one folding line in the line capturing device.
- the system has a mooring line for mooring the traction wing to the engagement interface of the mooring carriage, the length of this mooring line being controlled by the control module such that the mooring line is kept under tension during the furling mode and the folding mode;
- the length of the mooring line is controlled by the control module such that the mooring line is also kept under tension during the storage mode;
- the folding carriage has capturing means which are designed to slidingly capture at least one folding line;
- the folding carriage has capturing means which are designed to slidingly capture at least one closing line for closing the trailing edge of the traction wing;
- the furling carriage has capturing means which are designed to slidingly capture the furling line;
- the furling carriage is designed to capture the furling line at a loop which, when subjected to traction, causes traction on the furling line.

BRIEF DESCRIPTION OF THE DRAWINGS

Other features and advantages of the invention will emerge from the following nonlimiting description with reference to the appended drawings, in which:

FIG. 4 shows a side view of the traction system during a phase of folding the traction wing;

FIG. 5 is a partial perspective view of the traction wing as it is being folded;

FIG. 8 is an enlarged view of the traction wing showing a capturing device which is connected to the leading edge of the traction wing;

FIG. 9 is a side view of the capturing device;

Elements that are similar and shared by various embodiments bear the same reference numbers in the figures.

DETAILED DESCRIPTION OF THE INVENTION

Figure 1:
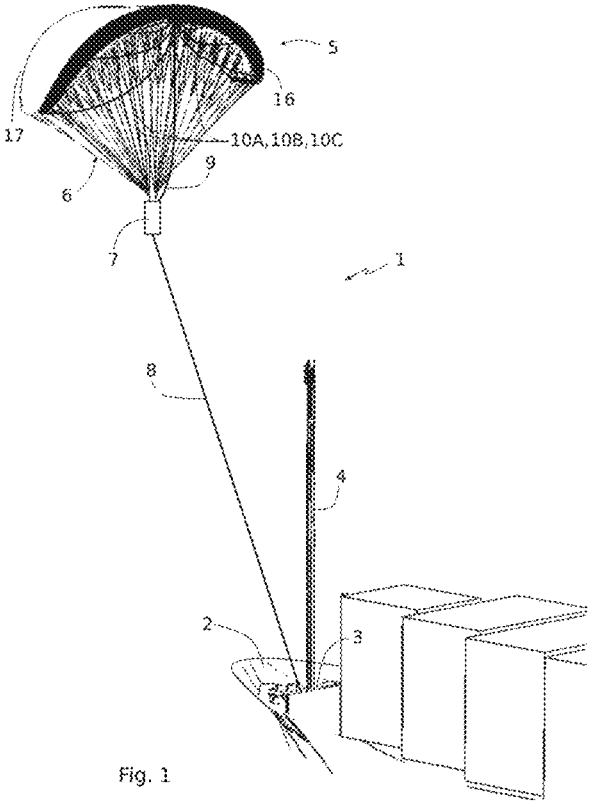
FIG. 1 is a perspective view of a traction system according to the invention.

FIG. 1 illustrates a tethered-wing traction system 1 mounted on a ship 2 which, in this example, is an ocean freight ship (in FIG. 1, only the front of the ship has been shown).

In the present example, the traction system 1 is mounted on the bow of the ship 2 and is actuated as a complementary propulsion means for the ship that makes it possible to save fuel. In this context, the traction system 1 is dimensioned depending on the tonnage of the ship to be hauled and is intended to be deployed and folded automatically.

In a variant, this traction system 1 may be used for any other application in which such an automatically foldable and deployable traction system is desired, for example as main propulsion means for a ship, for the propulsion of any other vehicle, for the generation of electricity, etc.

The traction system 1 has a base platform 3 which in this instance is fixed in place on the deck of the ship 2 and on which is mounted a mooring mast 4 provided for automatic folding and deployment operations of the system.

The traction system 1 also has a traction wing 5 which is designed to generate a traction force under the effect of the wind. In the present example, the traction wing 5 is a sail of the paraglider type. Any other flying equipment designed to generate a traction force under the effect of the wind can alternatively be employed, such as kites, gliding equipment, sails of the kite type, etc. The traction wing 5 conventionally has a leading edge 16 intended to be exposed to the ambient wind and an opposite edge, referred to as trailing edge 17.

The traction wing 5 is connected by an assembly of suspension lines 6 to a flying trajectory control device 7 which is designed to act on the suspension lines 6 to steer the flight of the traction wing 5.

The traction system 1 also has a traction line 8 connecting the flying trajectory control device 7 to the base platform 3. The traction force generated by the traction wing 5 is transmitted by the traction line 8 to the ship 2 to propel the latter, and the traction line is dimensioned accordingly. Within the context of the traction of an ocean freight ship, the traction line may be for example a textile cable of which the diameter may reach several centimeters.

The flying trajectory control device 7 makes it possible to steer the flight of the traction wing 5 in order to orient and position the traction wing and possibly to cause the traction wing 5 to describe flight paths that make it possible to increase the traction force on the ship. The control of the trajectory of the traction wing 5 is obtained in this instance by controlling the length of certain movable suspension lines, in a way which is conventional in the field of flying wings. The set of suspension lines 6 specifically has fixed suspension lines (that is to say that have a fixed length between their attachment to the traction wing 5 and their attachment to the flying trajectory control device 7) and movable suspension lines of variable length. The flying trajectory control device 7 is thus designed to pull on certain movable suspension lines and/or to slacken other movable suspension lines such that the aerodynamic profile of the traction wing 5 is modified with a view to controlling its lift, its trajectory, etc. The modification of the profile of a traction wing to control its trajectory is performed conventionally and will not be described in more detail here.

The traction wing 5 also has a guide line 9 and multiple folding lines 10A, 10B, 10C, which are all secured to the leading edge 16 by at least one of their ends.

Figure 2:
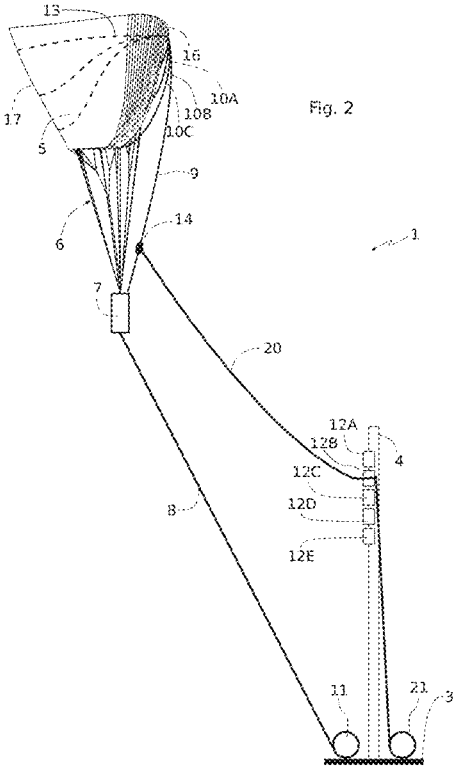
FIG. 2 illustrates a side view of the traction system.

FIG. 2 is a profile view of the traction system 1 in a phase of traction of the ship, as in FIG. 1. FIG. 2 also schematically illustrates constituent elements of the traction system 1.

The traction line 8 is connected to the base platform 3 via a winch 11 controlled by a motor, for example an electric or hydraulic motor, which is designed to unwind the traction line 8 to allow the traction wing 5 to gain altitude, or conversely to wind up this traction line 8 in order to bring the traction wing 5 towards the base platform 3.

FIGS. 1 and 2 illustrate the traction system 1 in a traction configuration, the traction wing 5 being deployed and in flight, and the system contributing to the propulsion of a ship.

The traction wing 5 has a furling line 13 which is divided into multiple lines (shown in dashed lines in FIG. 2) of which the ends are connected to the trailing edge 17 of the wing 5. This furling line 13 can be captured at the trailing edge 16 of the traction wing 5, and traction on this furling line 13 causes the wing 5 to be furled by compression with the aim of stowing it away.

The traction system 1 has carriages 12A, 12B, 12C, 12D, 12E, five of them in the present example. These carriages are fixed slidingly on the mooring mast 4 and each has a drive such that the position of each carriage along the mooring mast 4 can be managed.

These carriages are provided to capture and guide the folding lines 10A, 10B, 10C and the furling line 13 during the deployment or folding phases described later on.

These carriages are arranged as follows:

- the carriage 12A is a furling carriage and is designed to capture the furling line 13;
- the carriage 12B is a mooring carriage and is designed to ensure the mooring of the leading edge 16 of the traction wing 5;
- the carriage 12C is a first folding carriage and is designed to capture the first pair of folding lines 10A;
- the carriage 12D is a second folding carriage and is designed to capture the second pair of folding lines 10B;
- the carriage 12E is a third folding carriage and is designed to capture the third pair of folding lines 10C.

In a variant, the traction system 1 has as many carriages as are necessary to capture the folding or furling lines, the number of which can vary in relation to the example described.

The traction system 1 also has a control module 64 which controls the movement of the carriages 12A, 12B, 12C, 12D, 12E and the devices of each of the carriages for capturing the folding or furling lines. This control module 64 is realized conventionally by electronic equipment and computer hardware that is suitable for this application and is programmed to implement notably the process for deploying and folding the traction wing 5.

Figure 3:
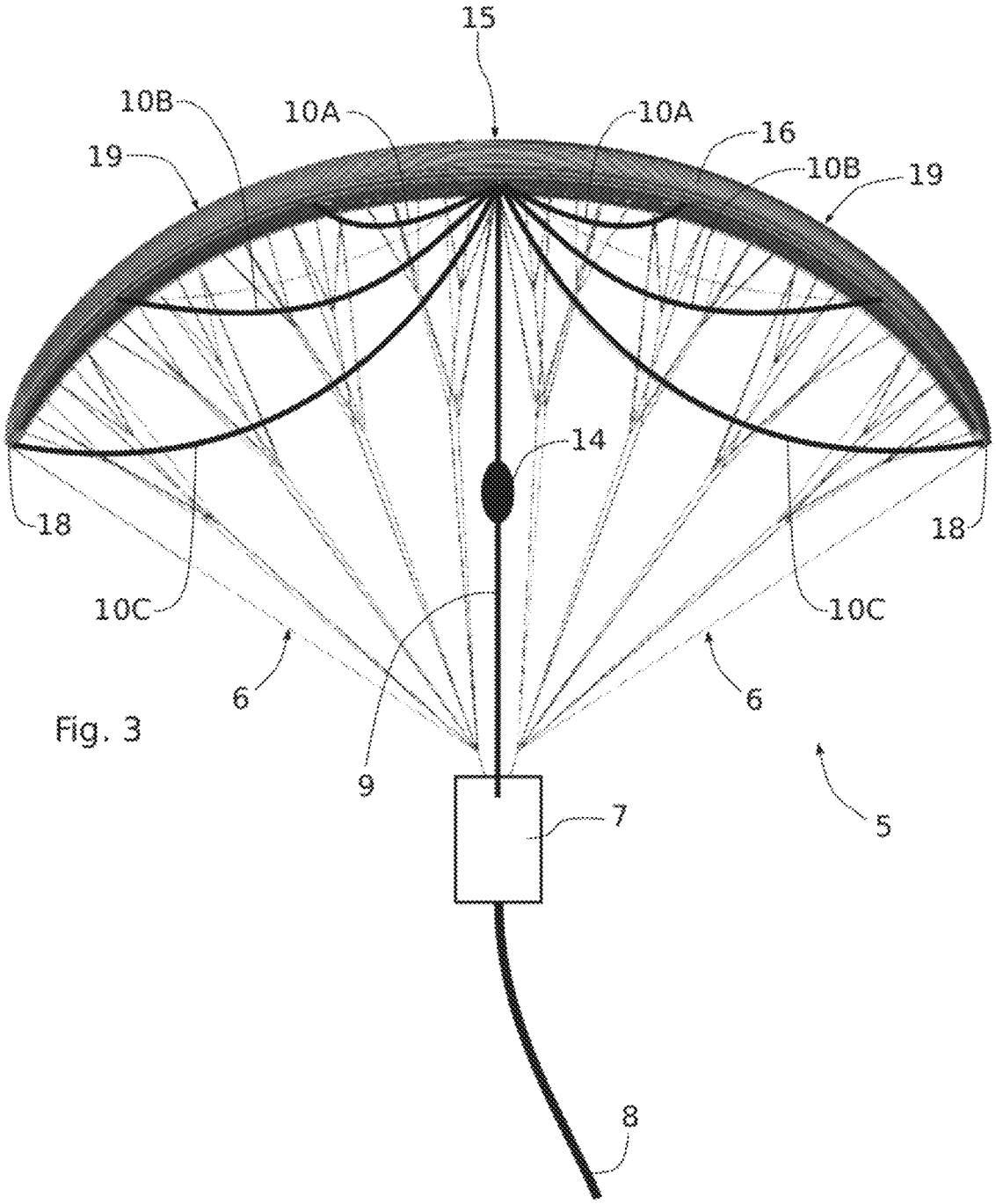
FIG. 3 shows a front view of the traction wing of the traction system from FIGS. 1 and 2.

The folding lines 10A, 10B, 10C are arranged in pairs, as illustrated in FIG. 3. In the present description, the leading edge 16 of the traction wing 5 is divided into a median zone 15 and two lateral edges 19 extending on either side of this median zone 15, between the median zone 15 and each of the lateral ends 18 of the leading edge 16.

In this FIG. 3, the front view of the traction wing 5 illustrates the routing of the folding lines 10A, 10B, 10C and their arrangement with respect to the leading edge 16:

- a first pair of folding lines 10A has two lines each having a first end connected at the median zone 15 of the leading edge 16, and a second end which is directly connected to the leading edge 16, at a certain distance from the median zone 15, in one of the lateral portions 19 of the leading edge 16;
- a second pair of folding lines 10B has two lines each having a first end connected at the median zone 15, and a second end directly connected to the leading edge 16, in one of the lateral portions 19, and in this example approximately in the middle of each lateral portion 19, that is to say approximately halfway between the lateral zone 15 and the lateral end 18;
- a third pair of folding lines 10C has two lines each connecting the median zone 15 to a portion of the leading edge 16 which is in the vicinity of the lateral end 18.

FIG. 3 also illustrates the routing of the guide line 9 between the central portion 15 and the flying trajectory control device 7.

With reference again to FIG. 2, the traction system 1 has a mooring line 20 which is wound up on a mooring winch 21 mounted on the base platform 3. The mooring line 20 leaves the winch 21 and is then guided into the mooring carriage 12B by one or more pulleys (or by low-friction elements, or any other element that makes it possible to slidingly route the mooring line 20 into the mooring carriage 12B). The mooring line 20 then enters a shuttle 14 which can slide along the guide line 9.

Taking the traction configuration of FIGS. 1 and 2 as a starting point, the traction wing 5 can be folded according to the process described below.

From the positions of FIGS. 1 and 2, the winches 11 and 21 are first of all made to retract the traction line 8 and the mooring line 20 such that the flying trajectory control device 7 comes to rest on the base platform 3, while the shuttle 14 rises along the guide line 9 as the traction wing 5 descends.

This operation continues as far as the position of FIG. 4, in which:

- the flying trajectory control device 7 rests on the base platform 3, for example on a suitable support (not shown);
- the shuttle 14 has slid upward, over the entire length of the guide line 9, to its end which is in the vicinity of the median zone 15.

The mooring line 20 enters the mooring carriage 12B and holds the leading edge 16 against the mooring carriage 12B by traction. The traction wing 5 is then locked in this moored position (as will be described later on), the tension on the mooring line 20 is no longer necessary, and the lines can be captured.

To capture the lines (these operations do not necessarily take place in this order):

- the furling carriage 12A captures the furling line 13;
- the first folding carriage 12C captures the first pair of folding lines 10A;
- the second folding carriage 12D captures the second pair of folding lines 10B;
- the third folding carriage 12E captures the third pair of folding lines 10C.

The lines are captured by virtue of hooks on the carriages, and a capturing device, as set out below.

The folding carriages 12C, 12D, 12E then start to descend along the mooring mast 4 by sliding their hooks along lines which have been caught.

FIG. 5 is a perspective view illustrating this operation of descent of the folding carriages. Each of the folding carriages 12C, 12D, 12E then entrains each of the folding lines gradually towards a configuration in which the lines are stretched vertically from the median zone 15 (which is moored to the mooring carriage 12B, which remains fixed in place) along the mooring mast 4. This operation makes it possible to bring back the lateral portions 19 vertically along the mooring mast 4.

Figure 6:
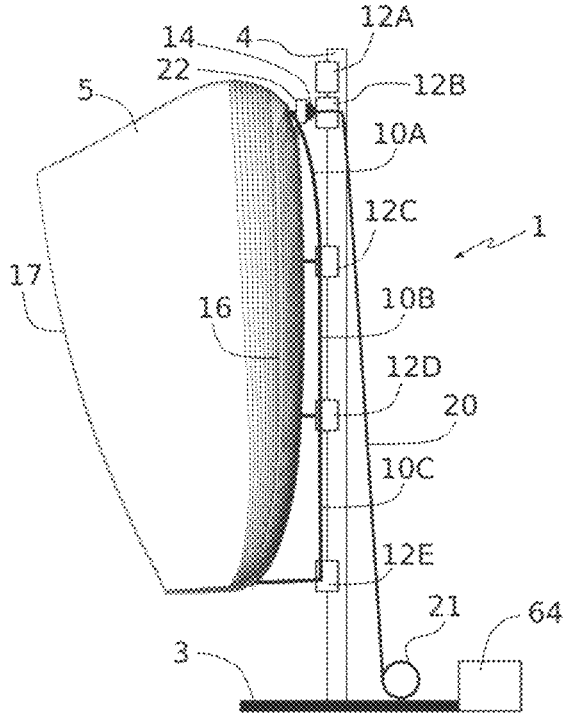
FIG. 6 shows a side view of the traction system, the traction wing being folded along the mooring mast.

FIGS. 6 (side view) and 7 (perspective view) illustrate the traction wing 5 after this folding operation, that is to say when the folding carriages 12C, 12D, 12E are each in their respective lowest position.

The traction wing 5 is then folded along the mooring mast 4, that is to say that the two lateral portions 19 of the leading edge 16 extend vertically along the mooring mast 4, while the median zone 15 is kept moored to the mooring carriage 12B.

Figure 7:
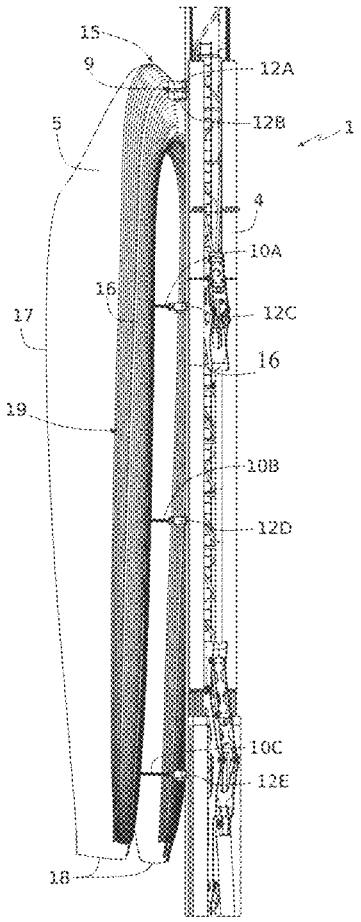
FIG. 7 is a perspective illustration of the traction wing folded along the mooring mast.

From this position in FIGS. 6 and 7, the wing 5 can then be furled. The furling carriage 12A (which has captured the furling line 13) is then made to slide upward along the mooring mast 4 and thus exerts traction on the furling line 13, thereby causing the traction wing 5 to be furled. In the present example, the furling is done by compression, by moving the trailing edge 17 close to the leading edge 16.

With reference to FIG. 6, the traction wing 5 is moored to the mooring carriage 12B by the interaction of the mooring line 20, the mooring carriage 12B, the shuttle 14 and a line capturing device 22.

FIG. 8 is a detail view of FIG. 3, illustrating the traction wing 5 in a front view and showing the median zone 15, and the attachment of the folding lines 10A, 10B, 10C and the furling line 13 to the median zone 15 of the leading edge 16 via the capturing device 22.

The capturing device 22 is connected to the leading edge 16 of the traction wing 15 in the median zone 15 by a pylon 23 (visible notably in the side view of FIG. 9). The pylon 23 is thus referred to analogously to the pylon of an aircraft, that is to say the engine pylon, in aeronautical terms. The pylon 23 is preferably made of a rib of lightweight and strong material, such as a carbon-fiber composite material. The pylon 23 is fixed to the capturing device 22 and to a reinforcement sewn to the leading edge 16 of the traction wing 5.

In a variant, the capturing device 22 may be connected to the leading edge 16 by any other flexible or stiff means, such as textile ties or any other element that makes it possible for traction on the capturing device 22 to cause traction on the leading edge 16.

The capturing device 22 has a body 24 and two fastening arms 25 mounted on this body 24 so as to be able to pivot each about a pin 26. Each of the fastening arms 25 has a first fastening rod 27A, a longer second fastening rod 27B, and an even longer third fastening rod 27C (the fastening rods 27A, 27B, 27C are seen in section in FIG. 8). This disposition, in which the juxtaposed fastening rods have an increasing, or decreasing, length, is referred to as "stepped" in this instance.

In the present example, the fastening rods 27A, 27B, 27C are made up of tubes force-fitted in bores provided to that end in the fastening arms 25.

The fastening arms are movable in relation to the body 24 between a flight position (that of FIG. 8) and a fastening position, in which the fastening rods 27A, 27B, 27C are disposed substantially vertically (when the traction wing 5 is in its normal moored position).

Each fastening arm 25 moreover has a lever 28, that is to say a portion extending beyond the pin 26 and making it possible to act on the fastening arm 25 to fold it.

Each folding line 10A, 10B, 10D, 10C which joins the median zone 15 is connected to a fastening rod 27A, 27B, 27C so as to protrude in the continuation of this fastening rod. In other words, the end of the fastening rod is continued by the folding line.

In the present example, in which the fastening rods are formed by tubes, the folding line is advantageously inserted in the tube and passes all through the tube to a fixing zone 29 of the fastening arm 25.

The pivot connection between the fastening arms 25 and the body 24 allows the fastening arms 25 to naturally take the spaced-apart position illustrated in FIG. 8 during the flight of the traction wing 5, the fastening arms 25 thus following the opening dictated by the folding lines 10A, 10B, 10C which extend in the direction of their other end, which is connected further on to the leading edge 16. The capturing device 22 may additionally have an elastic element (spring or the like) that urges the fastening arms 25 toward their spaced-apart position in FIG. 8.

The function of this spaced-apart position of the fastening arms 25 is to further secure the automatic fastening of the lines by limiting the risk of the fastening arms 25 and the fastening rods 27A, 27B, 27C becoming entangled with the other lines, such as the guide line 9 and the mooring line 20.

The shuttle 14 is also shown in section in FIG. 8. The shuttle 14 has two sliding orifices 32 and in this case has an oblong shape with two lateral flats 33. The oblong shape of the shuttle 14 enables guidance and angular orientation about a horizontal axis of the capturing device 22.

In this instance, the guide line 9 is made up of a pair of lines stretched between the body 24 and the flying trajectory control device 7. In the present example, the pair of guide lines 9 forms a loop around a stop 34 of the body 24.

The guide line 9 is thus attached to the median zone 15 via the capturing device 22.

The mooring line 20 passes through the shuttle 14 and is connected to the body 24. The shuttle 14 has a guide means through which the mooring line passes 20 and which makes it possible for the mooring line 20 to slide freely. This guide means is formed by any type of guide means, such as pulleys or low-friction elements. The mooring line 20 thus extends from the mooring carriage 12B and passes slidingly through the shuttle 14, being guided in the direction of the body 24.

FIG. 9 illustrates the capturing device 22 in a side view, disposed facing an interlocking interface 35 which is fixed to the mooring carriage 12B (the rest of the mooring carriage 12B has not been shown).

The interlocking interface 35 has elements for mooring the capturing device 22 in a predefined position. In the present example, these elements have an indentation 39 which complements an indentation 40 in the body 24. The shuttle 14 is also part of these positioning elements, since it is intended to engage in an impression 41 in the interlocking interface 35. The indentation 40 moreover has a significant advantage in terms of reacting forces, since the interaction of the indentations 39 and 40 makes it possible to react all the vertical forces which are exerted on the capturing device 22 during the folding operations, it being possible for these forces to be greater than 15 kN.

The impression 41 has inner walls for receiving and positioning the shuttle 14. The ovoid shape of the shuttle 14 and the complementary shape of the impression 41 ensure the predefined positioning when the capturing device 22 is being moored to the interlocking interface 35.

FIG. 9 also illustrates the arrangement of the furling line 13. The capturing device 22 has a furling rod 42 protruding vertically above the body 24. The furling line 13 protrudes in the continuation of the furling line 24. In the present example, the furling line 42 is formed by a tube fitted in the body 24, the furling line entering this tube and its end being fixed to the body 24.

Between its attachment to the furling line 42 and its journey toward the trailing edge 17, the furling line 13 forms a loop 55 and enters a ring 43 which is integral with the tube 42. The ring 43 is for example a low-friction ring, or may be formed by a tube or a pulley. Traction on the loop 55 thus causes traction on the furling line 13 and therefore furling of the traction wing 5.

Furthermore, the traction on the mooring line 20 during the phase of mooring the traction line causes the shuttle 14 to rise and ends with the shuttle 14 entering the receiving portion 36. The shuttle 14 is then immobilized in the receiving portion 36 by virtue of the dimensional fit that makes it possible for the surface of the flats 33, 38 to bear against the inner surfaces of the receiving portion 36.

The shuttle 14 is thus movable between a sliding configuration, in which it slides along the guide line 9, and a mooring configuration, in which the shuttle 14 is disposed in its receiving portion 36.

The entry of the shuttle 14 into the receiving portion 36 also activates the levers 28, this causing the fastening arms 25 to close, that is to say be transferred into the vertical position, and to be held in this position by way of the presence of the shuttle 14.

The traction on the mooring line 20 causes the capturing device 22 to move closer to the interlocking interface 35 until these two elements are coupled.

Figure 10:
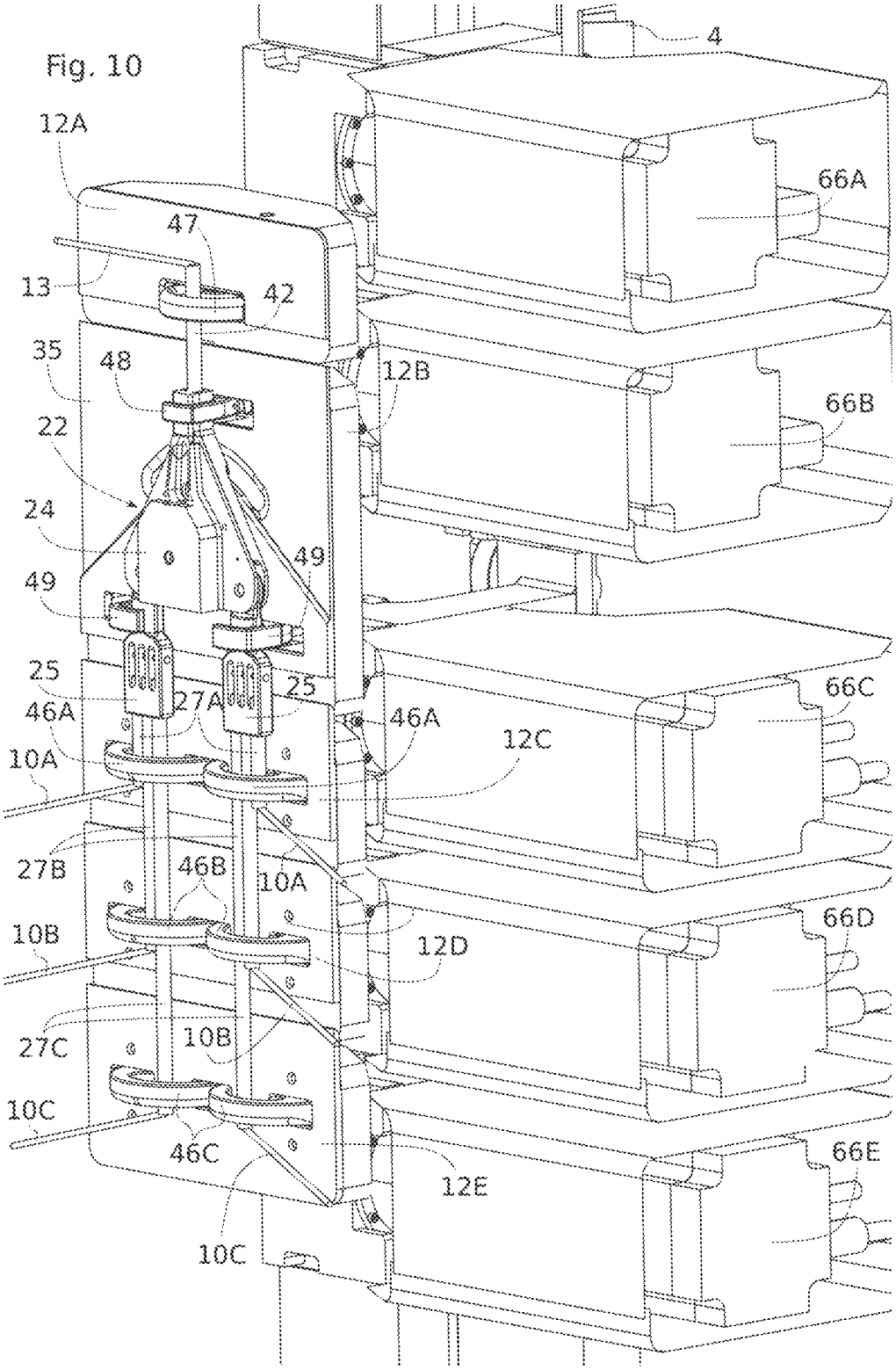
FIG. 10 shows the capturing device and the carriages of the traction system during a step of folding the traction wing.

FIG. 10 illustrates the capturing device 22 thus moored to the mooring carriage 12B. This figure also illustrates the other carriages 12A, 12C, 12D, 12E. Each of the carriages can slide along the mooring mast 4 controlledly by virtue of actuators 66A, 66B, 66C, 66D, 66E.

The mooring carriage 12B has an upper immobilizing hook 48 and a pair of lower immobilizing hooks 49, which are movable between a retracted position, in which they are spaced apart from the capturing device 22, and an immobilizing position (that shown in FIG. 10), in which they respectively lock the body 24 and the fastening arms 25 against the interlocking interface 35.

Each of the folding carriages 12C, 12D, 12E has a pair of capturing hooks 46A, 46B, 46C, each of these pairs of capturing hooks being intended to hook the corresponding pair of folding lines 10A, 10B, 10C. These hooks 12C, 12D, 12E are in the retracted position in FIG. 10.

The furling carriage 12A has a capturing hook 47 intended to actuate the furling line 13 by way of the loop 55. The capturing hook 47 is also retracted in FIG. 10.

The hooks 46A, 46B, 46C, 47, 48 are hooks which can pivot in the integral yokes of the corresponding carriage.

FIG. 10 illustrates the slide actuators 66A, 66B, 66C, 66D, 66E with which the carriages 12A, 12B, 12C, 12D, 12E, respectively, are fitted. Each carriage thus has a slide actuator 66A, 66B, 66C, 66D, 66E which is controlled by the control module 64 and makes it possible to manage the sliding, or the holding in a fixed position, of each carriage along the mooring mast 4. In the present example, these slide actuators are each made up of an electric motor coupled to a pinion which meshes with a fixed rack along the mooring mast. In a variant, these slide actuators may be made up of any means enabling this function, for example linear motors, offset rotary motors having chain or belt transmissions, etc.

During the process of folding the traction wing 5, once the capturing device 22 is coupled to the interlocking interface 35, the immobilizing hooks 48, 49 of the mooring carriage 12B are activated toward their immobilizing position to fix the capturing device 22 to the interlocking interface 35, as illustrated in FIG. 10. After this step, traction of the mooring line 20 is no longer necessary to maintain the mooring.

The upper immobilizing hook 48 clamps the upper part of the body 24 while the lower immobilizing hooks 49 clamp the fastening arms 25 at the fixing zone 29, that is to say above the fastening rods 27A, 27B, 27C.

Figure 11:
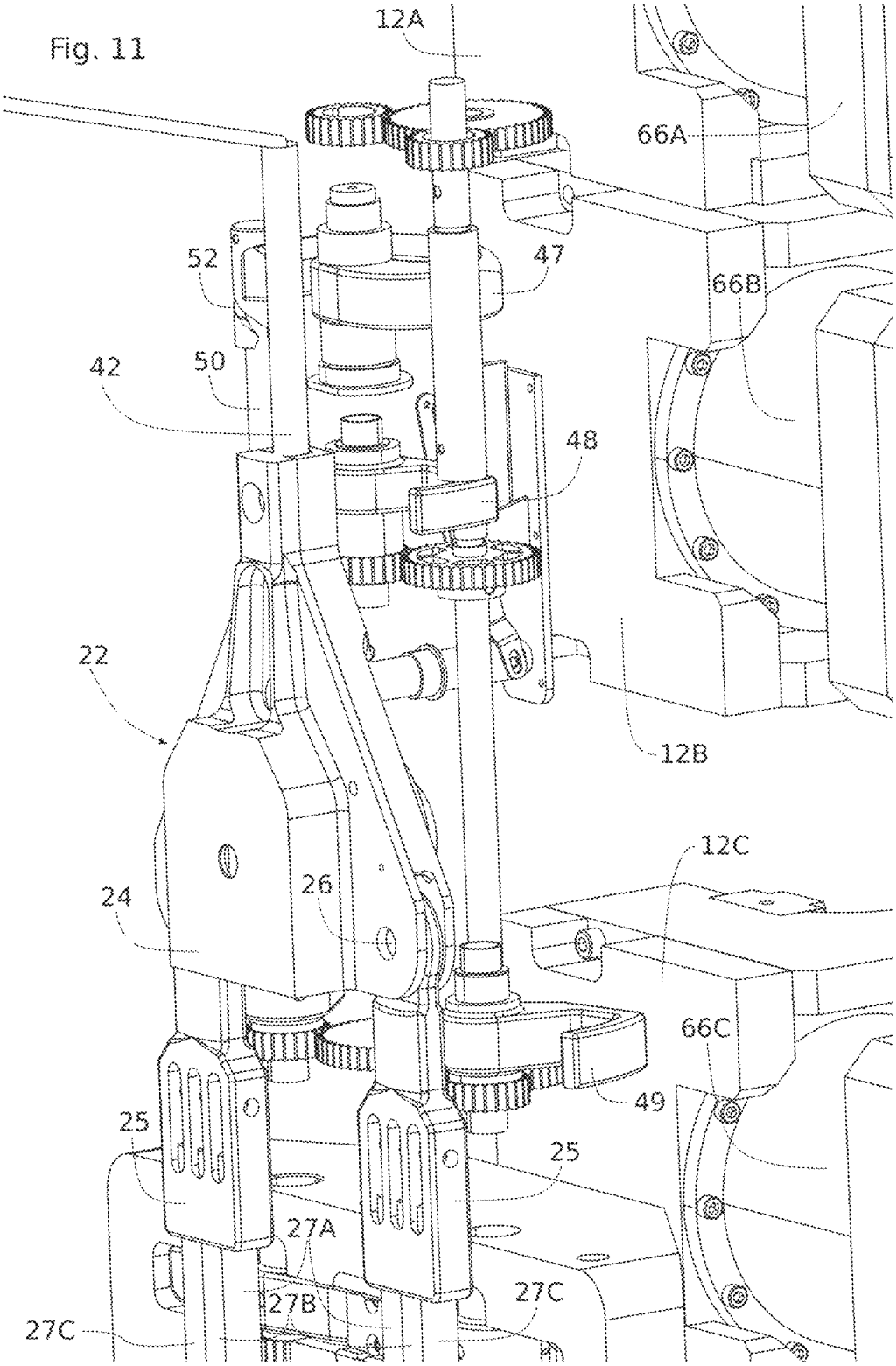
FIG. 11 shows the capturing device and the carriages of the traction system during another step of folding the traction wing.

The hooks 48, 49 can be activated by any means, such as a pivot means controlled by an electric motor, or remote-controlled magnetic actuating means. In the present example, the hooks 48, 49 are actuated by virtue of the movement of the furling carriage 12A. FIG. 11 shows the carriages in a transparent view to make the mechanism visible. The hooks 48, 49 are each mounted rotatably on the carriage and are actuated either by a shaft or by pinions. A control shaft 50 makes it possible to actuate the rotation of the set of three hooks 48, 49 by virtue of the arrangement of the pinions. As a result, the movement of the furling carriage 12A toward the mooring carriage 12B drives the hooks 48, 49 toward their retracted position, and the movement of the furling carriage 12A away from the mooring carriage 12B drives the hooks 48, 49 toward their immobilizing position.

The same type of mechanism makes it possible, with continued movement of the furling carriage 12A away from the mooring carriage 12B, to also drive the furling hook 47 toward its capturing position by virtue of a control shaft interacting with a helical camway.

In the same way as before, the capturing hooks 46A, 46B, 46C of the folding carriages 12C, 12D, 12E may also be managed by any means that make it possible to close them over the fastening rods 27A, 27B, 27C. In the present example, the capturing hooks 46A, 46B, 46C are preferably made to transfer to their capturing position by moving the corresponding folding carriage away from the preceding carriage, by virtue of the same type of control as above: with a control shaft, lug and helical camway.

Thus, with reference to FIG. 10, the furling carriage 12A is first of all moved slightly away from the mooring carriage 12B, this causing the immobilizing hooks 48, 49 to close and the capturing device 22 to be immobilized. The furling carriage 12A then remains in this position, the hook 47 being in the retracted position.

The folding carriages 12C, 12D, 12E then each start to descend along the mooring mast 4 while moving away from one another such that the pairs of hooks 46A, 46B, 46C close over the fastening rods 27A, 27B, 27C, as illustrated in FIG. 10.

Each hook 46A of the first folding carriage 12C closes over the three fastening rods 27A, 27B, 27C, that is to say just above the ends of the first fastening rods 27A.

Each hook 46B of the second folding carriage 12D closes over two fastening rods 27B, 27C, that is to say just above the ends of the second fastening rods 27B.

Each hook 46C of the third folding carriage 12E closes solely over a third fastening rod 27C, just above the ends of the third fastening rods 27C.

In this position in FIG. 10, each of the pairs of folding hooks 46A, 46B, 46C is thus just above the run-out of the corresponding folding lines 10A, 10B, 10C.

From the position in FIG. 10, the folding carriages 12C, 12D, 12E continue to descend such that:

- the third folding lines 10C are stretched vertically by the capturing hooks 46C which descend along the mooring mast 4 by sliding along these folding lines 10C;
- the second folding lines 10B are stretched vertically by the capturing hooks 46B which descend along the mooring mast 4 by sliding along these folding lines 10B and the folding lines 10C previously made to run vertically by the capturing hooks 46C;
- the first folding lines 10A are stretched vertically by the capturing hooks 46A which descend along the mooring mast 4 by sliding along these folding lines 10A and the folding lines 10B, 10C previously made to run vertically by the capturing hooks 46B, 46C.

As the carriages descend, the hooks 46A, 46B, 46C thus slide on their corresponding folding line, making this folding line run vertically along the mooring mast 4.

This descent continues until the folded position in FIGS. 6 and 7 is reached.

Once the folded position has been reached, the traction wing 5 can then be furled. The traction wing 5 is furled by moving the mooring carriage 12B and the furling carriage 12A away from one another, this first of all causing the furling hook 47 to close over the furling rod 42 (see FIG. 10). The continued rising of the furling carriage 12A then causes traction on the loop 55 (the loop 55 is visible in FIG. 9 and has not been shown in the other figures).

The process of folding the traction wing 5 will now be summarized with reference to the profile views of FIGS. 2, 4 and 6, and supplemented with reference to the profile views of FIGS. 12 to 17.

Starting from the flight position in FIG. 2, the traction wing 5 is first of all moored to the mooring carriage 12B by virtue of the capturing device 22, as described above. FIG. 4 illustrates the moored position of the traction wing 5 after this operation, the leading edge 16 of the traction wing 5 being moored to the mooring carriage 12B (in the present example, this mooring is done via the capturing device 22).

The folding carriages 12C, 12D, 12E then capture the folding lines 10A, 10B, 10C by virtue of their respective hooks 46A, 46B, 46C.

Then, the control module 64 controls the sliding of the folding carriages 12C, 12D, 12E along the mooring mast 4 so as to reach the folded position in FIG. 6.

To this end, the programming of the control module 64 includes a first mode of operation, referred to as "folding mode", in which the folding carriages 12C, 12D, 12E are moved away from the mooring carriage 12B. In the present example, the mooring carriage 12B remains fixed in place on the mooring mast 4 while the folding carriages 12C, 12D, 12E each descend along the mooring mast 4 down to the folded position illustrated in FIG. 6.

The independent control of the carriages furthermore makes it possible to perform additional functions, such as windsock-type folding of the traction wing 5 (by closing its trailing edges) by exerting traction on the closing lines (not shown) that are connected to the trailing edge 17, it being possible to optimize and manage this traction by way of the movements of the carriages.

Starting from the folded position in FIG. 6, the traction wing will then be simultaneously furled and stowed in a storage container 65, with reference to FIGS. 12 to 17.

FIGS. 12 to 17 illustrate an additional detail of the traction system 1: the mooring mast 4 continues below the base platform 3, and a storage container 65 for the traction wing 5 is disposed facing the mooring mast 4 at this continuation.

Figure 12:
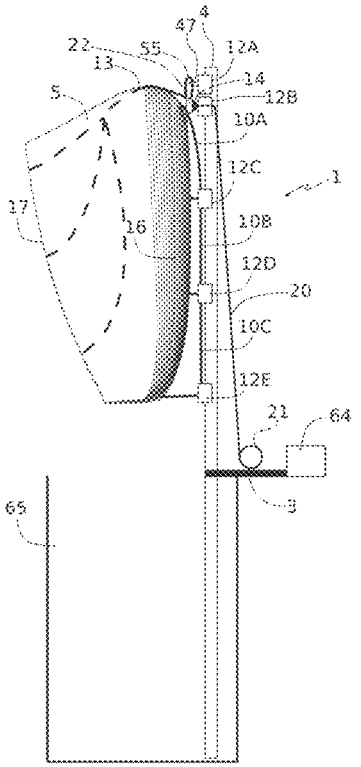
FIG. 12 is a side view of the traction system and illustrate a step of the process for folding the traction wing.

With reference to FIG. 12, the furling carriage 12A captures the furling line 13 at the furling loop 55, by virtue of its hook 47. It should be noted that, in a variant, the furling line 13 may be captured at any other moment than when the furling is performed, notably at the position in FIG. 4 or in FIG. 6.

When the traction wing 5 is folded along the mooring mast 4, and once the furling loop 55 is captured by the furling carriage 12A, all four of the mooring carriage 12B and the folding carriages 12C, 12D, 12E will be made simultaneously to move downward in translation. In other words, these four carriages 12B, 12C, 12D, 12E will each slide downward along the mooring mast 4 while still maintaining their respective mutual spacings.

To this end, the programming of the control module 64 includes a second mode of operation, referred to as "furling mode", in which the mooring carriage 12B and the furling carriage 12A are moved away from one another. In the present example, the furling carriage 12A remains fixed in place on the mooring mast 4 while the mooring carriage 12B slides downward. Moreover, the folding carriages 12C, 12D, 12E also descend along the mooring mast 4 conjointly with the mooring carriage 12B.

Starting from the position in FIG. 12, the control module then transfers to furling mode. In the furling mode, the control module 64 is thus designed to make the mooring carriage 12B, and also at least one folding carriage, descend such that the spacing between these carriages remains constant.

Figure 13:
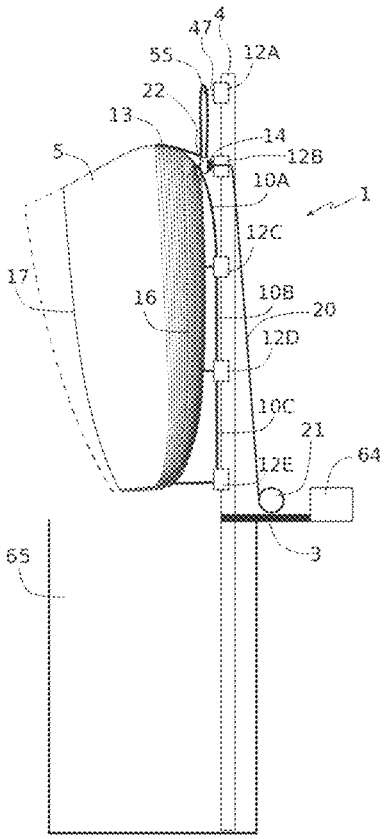
FIG. 13 is side view of the traction system and illustrate another step of the process for folding the traction wing.

This conjoint descent of the carriages 12B, 12C, 12D, 12E is illustrated in FIG. 13. The traction wing 5 thus descends along the mooring mast 4 while still remaining folded, that is to say keeping the same shape as in FIGS. 6 and 7. The traction wing 5 keeps this shape while still being moved as a whole in translation along the mooring mast 4.

As the thus-folded traction wing 5 descends, the mooring winch 21 is moreover controlled by the control module 64 so as to gradually wind up the mooring line 20. The mooring line 20 thus always has a small amount of tension, ensuring that no unwanted loop will form over the distance covered by the mooring line 20. This is because slack in the mooring line 20 at the start would run the risk of causing unintended locking of this mooring line 20, for example around one of the movable elements of the system.

As the traction wing 5 descends, the control module 64 keeps the furling carriage 12A fixed in place on the mooring mast 4. Moving the furling carriage 12A and the mooring carriage 12B away from one another causes traction on the furling loop 55. Since the furling carriage 12A has slidingly captured the furling loop 55 by way of the hook 47, this movement causes direct traction on the furling line 13, and therefore the furling of the traction wing 5. FIG. 13 thus illustrates the furling of the traction wing 5 by way of moving the trailing edge 17 toward the leading edge 16 (schematically shown by the dashed lines in FIG. 13).

Figure 14:
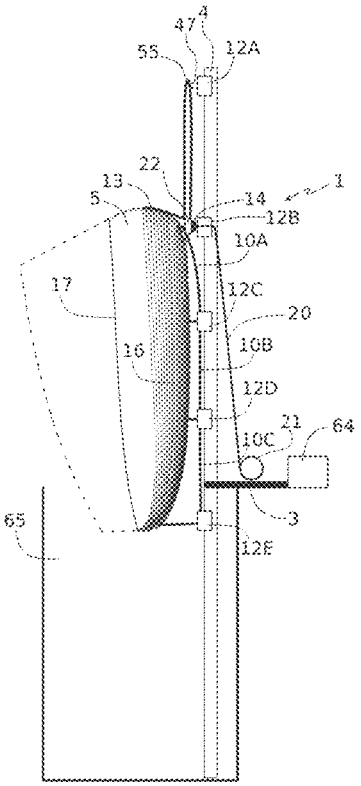
FIG. 14 is side view of the traction system and illustrate another step of the process for folding the traction wing.

FIG. 14 illustrates a subsequent step of the descent of the traction wing 5 while the control module 64 is in furling mode. The traction wing 5 continues to move in translation while staying in its folded position (the relative position of the mooring carriage 12B and folding carriages 12C, 12D, 12E having not been modified), whereas the furling carriage 12A is kept fixed in place, and the furling of the traction wing 5 continues.

Figure 15:
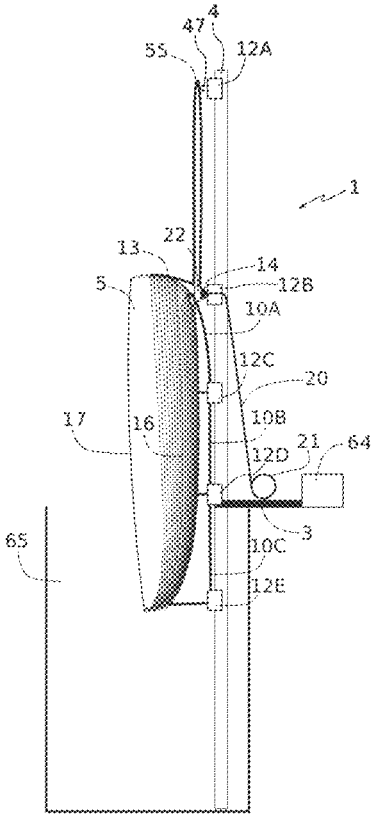
FIG. 15 is side view of the traction system and illustrate another step of the process for folding the traction wing.

The wing is thus furled at the same time as it is descending into the storage container 65 down to the maximally furled position illustrated in FIG. 15. In this position, although the traction wing has not yet been completely stowed, it is nevertheless folded and fully furled. It is moreover already partially introduced in the storage container 65 such that it experiences less forces linked to the wind.

The control module 64 then transfers to another mode of operation referred to as "storage mode", by virtue of which the traction wing will be stowed in the container 65.

Figure 16:
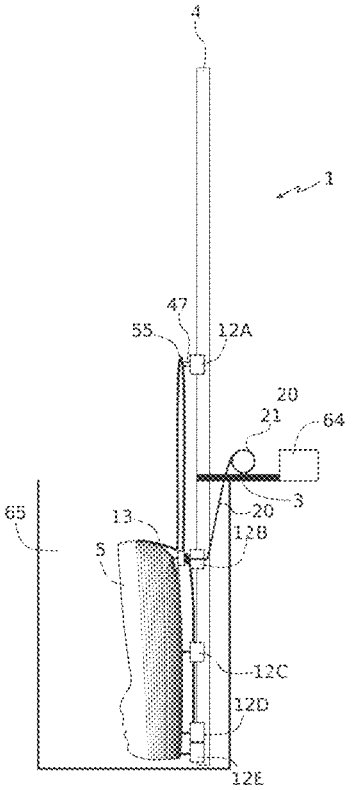
FIG. 16 is side view of the traction system and illustrate another step of the process for folding the traction wing.

With reference to FIG. 16, the folding process then continues with this storage mode, wherein:

- all of the carriages are moved downward in translation until the third folding carriage 12E reaches its bottom abutment position (that visible in FIG. 16). The traction wing 5 is thus slid along the mooring mast toward the container 65, while remaining furled;
- and then the relative spacing between the furling carriage 12A and the mooring carriage 12B continues to be kept fixed, while the mooring carriage 12B and at least one of the folding carriages 12C, 12D, 12E are moved close to one another.

In the present example, the furling carriage 12A and the mooring carriage 12B descend conjointly along the mooring mast 4, the control module 64 maintaining their mutual spacing, while the folding carriages 12C, 12D, 12E are moved close to one another. The mooring carriage 12B therefore moves close to at least one folding carriage 12A, 12B, 12C. In practice, in this example, the mooring carriage 12B and the two first folding carriages 12C, 12D together are moved close to the third folding carriage 12E (which is kept fixed in its bottom abutment position), and then the second folding carriage 12D meets the third folding carriage 12E (this is the position illustrated in FIG. 16).

Then, the movement continues the carriage 12C, which moves close to the carriage 12D (conjointly with the carriages 12A and 12B, which follow while keeping their spacing constant), which remains fixed in place against (or close to) the carriage 12E. The first folding carriage 12C then meets the second folding carriage 12D, down to a position in which the four carriages 12B, 12C, 12D, 12E come into abutment close to one another (the configuration illustrated in FIG. 17).

In a variant, all the folding carriages 12C, 12D, 12E can be simultaneously moved close to the mooring carriage 12B when the latter is sliding downward.

In another variant for the storage mode, the furling carriage 12A and the mooring carriage 12B slide downward while keeping their mutual spacing constant, and at least one of the folding carriages 12C, 12D, 12E slides downward at a slower speed than the sliding speed of the mooring carriage 12B.

Figure 17:
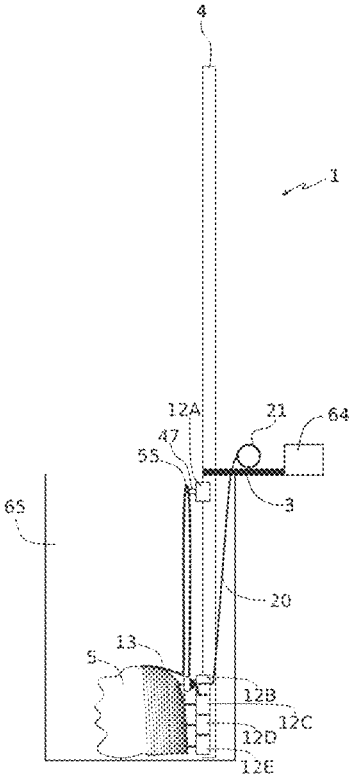
FIG. 17 is side view of the traction system and illustrate another step of the process for folding the traction wing.

FIG. 17 illustrates this final position in which the traction wing 5 is kept stowed in the storage container 65. The mooring carriage 12B and the folding carriages 12C, 12D, 12E are close to one another (or even butt against one another), and the spacing between the furling carriage 12A and the mooring carriage 12B has been kept the same (the furling carriage 12A has slid along the mooring mast conjointly with the mooring carriage 12B).

During all the operations above, the mooring line 20 is kept under a small amount of tension as mentioned above by virtue of the control of the mooring winch 21. Moreover, the maintenance of the mutual spacing between the furling carriage 12A and the mooring carriage 12B makes it possible to keep the sail furled while it is in storage.

The sail may thus be stored in the storage container 65 in this position of FIG. 17 if the sail is to be kept furled even while it is in storage. In a variant, it is also possible, in an additional operation, to move the furling carriage 12A close to the mooring carriage 12B such that the tension of the traction wing 5 is released inside the storage container 65. In this case, the wing will be refurled by raising the furling carriage 12A before redeploying the traction wing 5.

The operations of folding, furling and storing the traction wing 5 are thus interlinked by the set of carriages 12A, 12B, 12C, 12D, 12E. Other functions may also be performed by this set of carriages, such as the closure of the trailing edge of the traction wing by way of traction on the closing lines.

The process for folding the traction wing 5 is thus finished and the wing remains stored in its storage container 65 until it is next deployed.

The deployment of the traction wing 5 is obtained by the same operations as those described above, in reverse order. The control module 64 thus includes, in reversed fashion in relation to the furling mode, the folding mode and the storage mode:

- a release mode, in which the furling carriage 12A and the mooring carriage 12B are moved upward in translation along the mooring mast 4 with their mutual spacing being kept constant, which corresponds to the maximum furling of the traction wing 5. In this mode, the mooring carriage 12B is first of all moved away as far as possible from the first folding carriage 12C, the latter then itself slides upward, conjointly with the two other carriages 12A, 12B, and is moved away as far as possible from the second folding carriage 12D. Then, this carriage 12D itself slides upward, conjointly with the three other carriages 12A, 12B, 12C, and is moved away from the third folding carriage 12E as far as possible, up to the position of FIG. 15. In a variant of the release mode, the furling carriage 12A and the mooring carriage 12B slide upward while keeping their mutual spacing constant, and at least one folding carriage 12C, 12D, 12E slides upward at a slower speed than the sliding speed of the mooring carriage 12B;

an unfurling mode, in which, starting from the position in FIG. 15, the furling carriage 12A and the mooring carriage 12B are moved close to one another. In the present example, the furling carriage 12A is kept fixed in place on the mooring mast while the set of carriages 12B, 12C, 12D, 12E continue to slide upward, conjointly, up to the unfurled position in FIG. 12;

an unfolding mode, in which the mooring carriage 12B and at least one folding carriage are moved close to one another. In the present example, all the folding carriages 12C, 12D, 12E slide upward along the mooring mast 4, while the furling carriage 12A and the mooring carriage 12B are kept fixed in place against one another, up to the unfolding position of FIG. 4 in which the traction wing 5 is ready to fly. The leading edge 16 can then be released (by releasing the hooks 48, 19 and the mooring line 20) and the traction wing reaches its flight position.

Variant embodiments of the traction system and the associated processes can be implemented. Notably, any other means for capturing the furling lines 13 and the folding lines 10A, 10B, 10C can be envisaged.

Similarly, the slide actuators 66A, 66B, 66C, 66D, 66E may be individual actuators for each corresponding carriage, or be shared by a single common actuator associated with suitable transmission means for each of the carriages.

The modes of operation of the control module may be optionally implemented sequentially in a different order, or simultaneously.

Notably, starting from the folded position in FIG. 6, the traction wing 5 is simultaneously furled and stowed in the storage container 65. However, it is also possible to furl the traction wing first, by raising the furling carriage 12A and by keeping the other carriages fixed in place. These various kinematics solutions can also be combined.

The invention claimed is:

1. A tethered-wing traction system comprising:

a traction wing (5) to generate a traction force under the effect of the wind, the traction wing (5) having a leading edge (16) and a trailing edge (17);

a base platform (3) connected to the traction wing via a traction line (8), the traction wing (5) to be deployed and folded in relation to the base platform (3);

a mooring mast (4) for the traction wing (5), disposed on the base platform (3);

multiple folding lines (10A, 10B, 10C) each having an end fixed to the leading edge (16) of the traction wing (5), the ends being spaced apart from one another along the leading edge (16);

a furling line (13) connected to the trailing edge (17) of the traction wing (5);

a mooring carriage (12B) designed to slide along the mooring mast (4) and controlled by a slide actuator (66B), the mooring carriage (12B) having an engagement interface (35) designed to keep the leading edge (16) of the traction wing (5) moored;

a folding carriage (12C, 12D, 12E) to slide along the mooring mast (4) and controlled by a slide actuator (66C, 66D, 66E), the folding carriage (12C, 12D, 12E) having a capturing device (46A, 46B, 46C) to capture at least one folding line (10A, 10B, 10C);

a furling carriage (12A) to slide along the mooring mast (4) and controlled by a slide actuator (66A), the furling carriage (12A) having a capturing device (47) to capture the furling line (13);

a control module (64) for controlling said slide actuators (66A, 66B, 66C, 66D, 66E), the control module (64) having at least the following two modes of operation: a folding mode in which the mooring carriage (12B) and the folding carriage (12C, 12D, 12E) are moved away from one another; a furling mode in which the furling carriage (12A) and the mooring carriage (12B) are moved away from one another.

2. The tethered-wing traction system as claimed in claim 1, wherein in the folding mode, the mooring carriage (12B) is kept fixed in place on the mooring mast (4) and the folding carriage (12C, 12D, 12E) slides downward.

3. The tethered-wing traction system as claimed in claim 1, wherein in the furling mode, the furling carriage (12A) is kept fixed in place on the mooring mast (4) and the mooring carriage (12B) slides downward.

4. The tethered-wing traction system as claimed in claim 1, wherein in the furling mode, the furling carriage (12A) slides upward, and the mooring carriage (12B) is kept fixed in place on the mooring mast (4).

5. The tethered-wing traction system as claimed in claim 4, wherein in the furling mode, the folding carriage (12C, 12D, 12E) also slides downward, the spacing between the mooring carriage (12B) and the folding carriage (12C, 12D, 12E) being kept constant.

6. The tethered-wing traction system as claimed in claim 1, wherein the control module (64) includes the following mode of operation: an unfurling mode in which the furling carriage (12A) and the mooring carriage (12B) are moved close to one another.

7. The tethered-wing traction system as claimed in claim 6, wherein in the unfurling mode, the furling carriage (12A) is kept fixed in place on the mooring mast (4) and the mooring carriage (12B) slides upward.

8. The tethered-wing traction system as claimed in claim 1, wherein the control module (64) includes the following mode of operation: an unfolding mode in which the mooring carriage (12B) and the folding carriage (12C, 12D, 12E) are moved close to one another.

9. The tethered-wing traction system as claimed in claim 8, wherein in the unfolding mode, the mooring carriage (12B) is kept fixed in place on the mooring mast (4) and the folding carriage (12C, 12D, 12E) slides upward.

10. The tethered-wing traction system as claimed in claim 1, wherein the control module (64) includes the following mode of operation: a storage mode in which the spacing between the furling carriage (12A) and the mooring carriage (12B) is kept constant, while the mooring carriage (12B) and the folding carriage (12C, 12D, 12E) are moved close to one another.

11. The tethered-wing traction system as claimed in claim 10, wherein in the storage mode, the furling carriage (12A) and the mooring carriage (12B) slide downward while keeping their mutual spacing constant, and the folding carriage (12C, 12D, 12E) slides downward at a slower speed than the sliding speed of the mooring carriage (12B).

12. The tethered-wing traction system as claimed in claim 10, wherein in the storage mode, the folding carriage (12C, 12D, 12E) is kept fixed in place.

13. The tethered-wing traction system as claimed in claim 10, wherein the control module (64) includes the following mode of operation: a release mode in which the spacing between the furling carriage (12A) and the mooring carriage (12B) is kept constant, wherein the mooring carriage (12B) and the folding carriage (12C, 12D, 12E) are moved away from one another.

14. The tethered-wing traction system as claimed in claim 13, wherein in the release mode, the furling carriage (12A) and the mooring carriage (12B) slide upward while keeping their mutual spacing constant, and the folding carriage (12C, 12D, 12E) slides upward at a slower speed than the sliding speed of the mooring carriage (12B).

15. The tethered-wing traction system as claimed in claim 1, further comprising a line capturing device (22) which is connected to the leading edge (16) of the traction wing (5) and is designed to be coupled to the engagement interface (35) of the mooring carriage (12B), the furling carriage (12A) being designed to capture the furling line (13) in the line capturing device (22), and the folding carriage (12C, 12D, 12E) being designed to capture at least one folding line (10A, 10B, 10C) in the line capturing device (22).

16. The tethered-wing traction system as claimed in claim 1, further comprising a mooring line (20) for mooring the traction wing (5) to the engagement interface (35) of the mooring carriage (12B), the length of the mooring line (20) being controlled by the control module (64) such that the mooring line (20) is kept under tension during the furling mode and the folding mode.

17. The tethered-wing traction system as claimed in claim 16, when dependent on claim 10, wherein the length of the mooring line (20) is controlled by the control module (64) such that the mooring line (20) is also kept under tension during the storage mode.

18. A process for folding the traction wing of a traction system as claimed claim 1, the process comprising the following steps:

mooring the leading edge (16) of the traction wing (5) to the mooring carriage (12B);

capturing at least one folding line (10A, 10B, 10C) by way of the folding carriage (120, 12D, 12E);

sliding the folding carriage (12C, 12D, 12E) downward while the mooring carriage (12B) remains fixed in place on the mooring mast (4);

capturing the furling line (13) by way of the furling carriage (12A);

sliding the mooring carriage (12B) downward while the furling carriage (12A) remains fixed in place on the mooring mast (4).

19. A process for deploying the traction wing of a traction system as claimed in claim 1, the process comprising the following steps:

sliding the mooring carriage (12B) upward while the furling carriage (12A) is kept fixed in place on the mooring mast (4);

sliding the folding carriage (12C, 12D, 12E) upward while the mooring carriage (12B) is kept fixed in place on the mooring mast (4).

* * * * *